United States Patent [19]

Goncalves et al.

[11] Patent Number: 4,662,530

[45] Date of Patent: May 5, 1987

[54] BOTTLE AND CLOSURE HAVING POSITIONING CATCHES

[75] Inventors: Antonin L. Goncalves, Groslay; François Bigotte, Le Vesinet, both of France

[73] Assignee: L'Oreal, Paris, France

[21] Appl. No.: 783,548

[22] Filed: Oct. 3, 1985

[30] Foreign Application Priority Data

Oct. 11, 1984 [FR] France ..... 84 15590

[51] Int. Cl.[4] ..... B65D 41/04

[52] U.S. Cl. ..... 215/330; 215/31; 215/331

[58] Field of Search ..... 215/330, 331, 31

[56] References Cited

U.S. PATENT DOCUMENTS

| | | | |
|---|---|---|---|
| 4,093,096 | 6/1978 | Augros | 215/330 |
| 4,310,101 | 1/1982 | Sekine | 215/330 |
| 4,387,822 | 6/1983 | Lynn | 215/330 |

FOREIGN PATENT DOCUMENTS

| | | | |
|---|---|---|---|
| 455545 | 7/1968 | Switzerland | 215/330 |

*Primary Examiner*—Donald F. Norton

*Attorney, Agent, or Firm*—Cushman, Darby & Cushman

[57] ABSTRACT

The stoppering device comprises an internally threaded stopper and an externally threaded bottle neck, the bottle neck being provided with a flange situated axially between on the one hand the lower end of the thread of the neck and on the other hand the body of the bottle proper, the bottle neck comprising on this flange at least two radially outwardly projecting catches of which one constitutes an orientation stop and the other a lobe to prevent unscrewing. The stopper comprises at least one catch made of a slightly deformable substance which, after screwing down, becomes accommodated between the two catches of the bottle neck. The orientation stop and the lobe to prevent unscrewing have different shapes, and the orientation stop extends along a direction parallel to the axis of the bottle neck over an axial extent which is greater than that of the flange and the orientation stop projects in relation this flange on the opposite side from the thread.

10 Claims, 2 Drawing Figures

BOTTLE AND CLOSURE HAVING POSITIONING CATCHES

FIELD OF THE INVENTION

The invention relates to a stoppering device with an indexed closure position, for a bottle made of glass or another rigid substance. The device is of the type comprising an internally threaded stopper and an externally threaded bottle neck which is provided with a flange situated axially between the lower end of the thread of the neck and the body of the bottle proper, the bottle neck comprising on this flange, at least two radially outwardly projecting catches one of which constitutes an orientation stop and the other constitutes a lobe to prevent unscrewing, while the stopper comprises at least one catch made of a slightly deformable material which, on completion of the screwing action, comes to be accommodated between the two catches of the bottle neck.

PRIOR ART

A device of this kind is, in particular, known from published French patent application No. 2 036 272. However, the accuracy of positioning the stopper on completion of the screwing action is inadequate; in particular, if the user continues to screw the stopper down, the catch of the stopper may become partly engaged or even cross the orientation stop, in which case the stopper is not located in the desired position.

The indexation of the closing stopper with a view to aesthetic appeal, is generally provided on bottles having a polyhedral shape and closed by stoppers also having an external polyhedral shape. The indexation allows the stopper to end up in a given position, for instance in a position wherein the sides of the stopper are parallel with those of the bottle.

OBJECTS OF THE INVENTION

The principal object of the invention is to provide a stoppering device of the kind defined above which would make it possible to ensure a precise closure position of the stopper, in a simple way which is easily obtainable in mass production. It is, moreover, an object of the invention to enable the sealing function of the stopper to be suitably ensured.

SUMMARY OF THE INVENTION

In accordance with the invention, a bottle stoppering device of the kind defined above, is characterised in the the orientation stop and lobe to prevent unscrewing should have different shapes and the orientation stop entends along a direction parallel to the axis of the bottle neck, over a height greater than that of the flange, and projects in relation to this flange on the opposite side to the thread.

The orientation stop may continue down as far as the shoulder of the bottle.

Advantageously, this orientation stop has a flat radial side constituting a stop side capable of cooperating with a corresponding side provided on the catch of the stopper.

The orientation stop and the lobe to prevent unscrewing provided on the bottle neck, project radially outwardly beyond the external surface of the flange of the neck.

The orientation stop generally has a rounded outwardly convex side beyond its stop side. The orientation stop generally starts at the level of the upper surface of the flange, that is to say, at the level of the surface of the flange turned towards the thread of the bottle neck.

Preferably, provision is made for two pairs of diametrically opposite catches on the bottle neck, each pair of catches being constituted by an orientation stop and a lobe to prevent unscrewing, the stopper comprising two diametrically opposite catches associated with each pair of catches of the bottle neck.

The positioning of the orientation stops in relation to the axis of the opening of the glass bottle neck moulds is chosen in such a way that no variation can occur in the profile of these stops.

As follows from the characteristics set out above, the orientation stops are asymmetrical.

The lobes to prevent unscrewing are, on the other hand, symmetrical, rounded and entirely situated on the flange. These lobes are situated ahead of the orientation stops, along the screwing down direction of the stopper. The positioning of these lobes in relation to the axis of opening of the glass moulds is also chosen in such a way that no variation in their profile can occur.

The catch or catches of the stopper project radially inwardly.

The stopper generally has a polyhedral shape, especially with a substantially square or rectangular cross section. The stopper catch is advantageously provided near a corner of the transverse cross section so as to be located along the radial direction outside the cylindrical surface enveloping the thread of the bottle neck.

When the stopper comprises two diametrically opposite catches, these catches are situated substantially at the ends of a diagonal of the transverse cross section of the stopper.

The invention also concerns a bottle made of glass or another rigid substance characterised in that it is provided with a stoppering device with an indexed closure position having the characteristics set out above.

BRIEF DESCRIPTION OF THE DRAWINGS

Apart from the arrangement set out above, the invention is associated with certain other features which will be discussed in greater detail below in relation to a particular embodiment described with reference to the attached drawings, but which is in no way restrictive.

In these drawings.

DESCRIPTION OF THE PREFERRED EMBODIMENT

Figure 1:
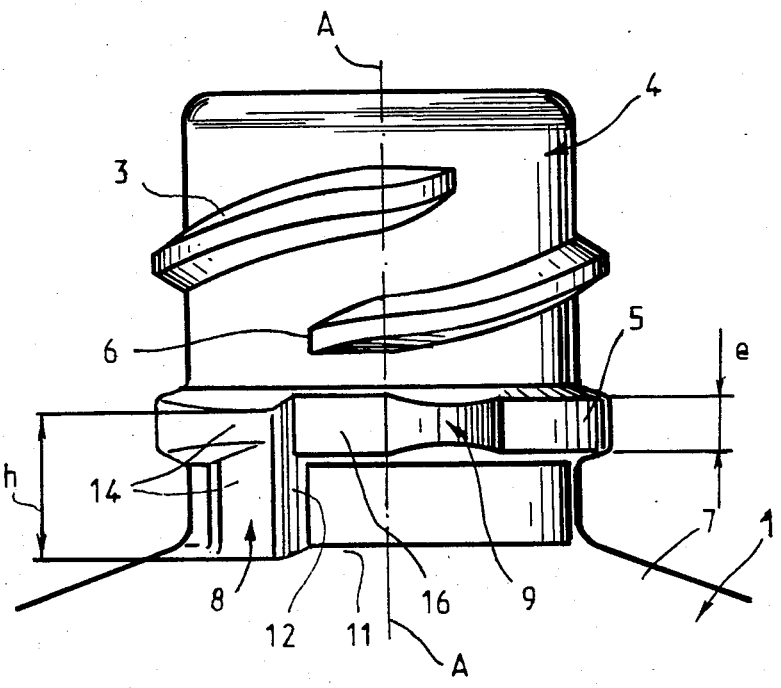
FIG. 1 shows, in elevation, a bottle neck constituting a part of a stoppering device in accordance with the invention.

Referring to the drawings, it will be seen that the stoppering device for a bottle 1, of glass or other rigid substance, comprises a stopper 2 provided with an internal thread (not visible in the drawings) intended to cooperate with the external thread 3 (FIG. 1) provided on a cylindrical neck 4 of the bottle 1.

Neck 4 is provided with a cylindrical ring flange 5 situated at a position along the axis A—A of neck 4 between the lower end 6 of the thread and the body 7 of the bottle.

The neck 4 of the bottle further comprises, on the flange 5, at least two radially outwardly projecting catches on of which constitutes an orientation stop 8 whilst the other constitutes a lobe 9 to resist unscrewing.

Figure 2:
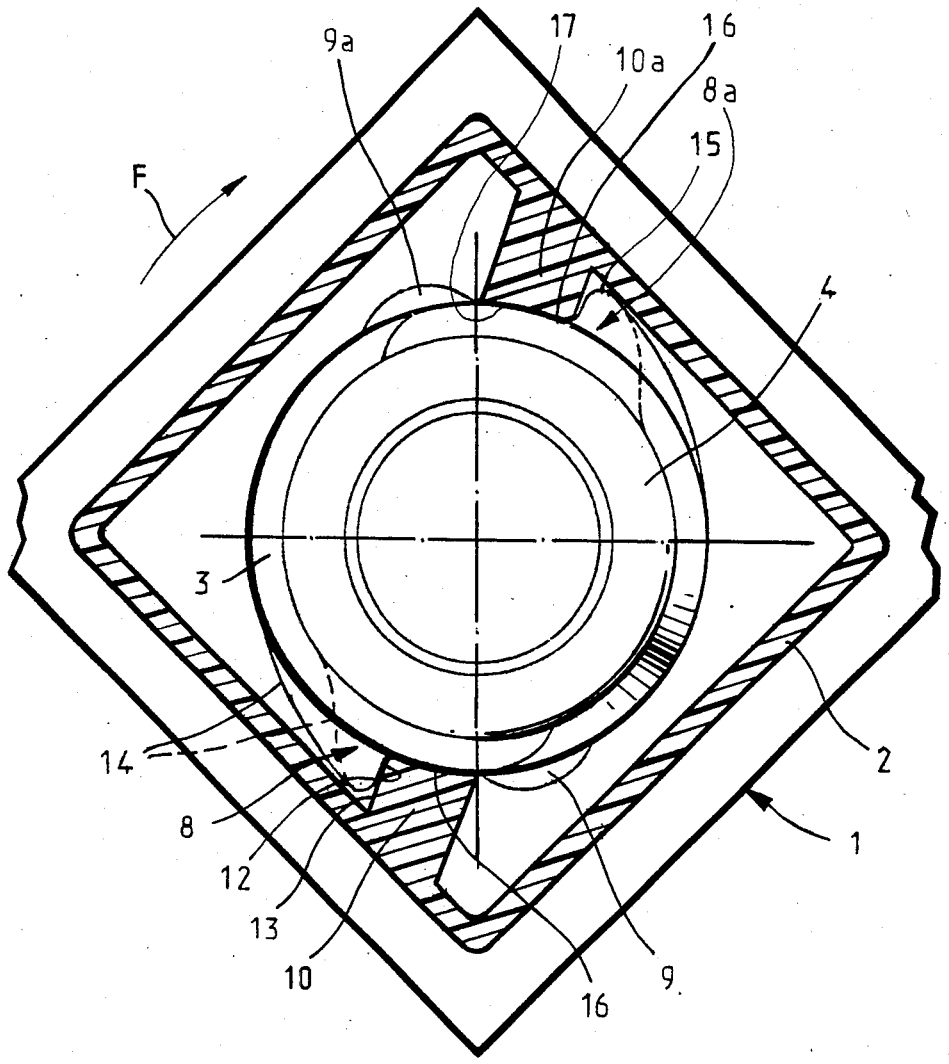
FIG. 2 is a cross section on a transverse plane through the lower part of the stopper, and giving a top view of the bottle.

As may be seen in FIG. 2, the stop 8 and lobe 9 project radially outwardly beyond the external radial surface of the thread 3 of the neck.

As can be seen in FIG. 2, there may preferably be two pairs of diametrically opoosite such catches on the neck 4, each of the pairs being constituted by an orientation stop 8, 8*a* and by a lobe 9. 9*a* to prevent unscrewing.

The stopper 2 comprises at least one catch 10 of a slightly deformable material, especially a plastic material, which at the end of the screwing action becomes accommodated between the catches 8, 9 of the bottle neck 4. Advantageously, the stopper 2 comprises two diametrically opposite such catches 10, 10*a* each associated with a respective one of the two pairs of catches of the bottle neck. The catches 10, 10*a* of the stopper project radially inwardly of the stopper.

The orientation stop 8, 8*a* and the lobe 9, 9*a* have different shapes.

The orientation stop 8, 8*a* has a height h (measured along a direction parallel to the axis A—A) which exceeds the height e (along the same direction) of the flange 5. In relation to the flange 5, the stops 8, 8*a* and the thread 3 project on opposite sides.

Each stop 8, 8*a* may continue down as far as the shoulder 11 of the bottle (as illustrated in FIG. 1), or may terminate short of the shoulder 11. Each orientation stop has a flat radial side 12 constituting a stop face capable of cooperating with a corresponding face 13 (FIG. 2) on the catch 10 or 10*a* of the stopper. The other face 14 of the stop 8 or 8*a* situated ahead of the face 12, along the "screwing down" direction indicated by arrow F in FIG. 2, has a shape which is outwardly convex and is joined progressively to the exterior radial surface of the flange 5. It will be seen that the shape of the stops 8, 8*a* is asymmetrical in relation to a plane passing through the axis A—A and through the centre of the stop 8, or 8*a* along the peripheral direction. The edge 15 joining the faces 12 and 14 is rounded off.

On the other hand, lobes 9, 9*a* have a rounded symmetrical shape in relation to a plane passing through axis A—A and through the centre of the lobe along its peripheral direction. These lobes 9, 9*a* are provided only on the flange 5 and do not project along a direction parallel to axis A—A on the transverse (i.e. upper and lower) sides of the flange 5.

The dimensions of the catches 10, 10*a* of the stopper (see FIG. 2) are such that these catches come to be inserted in spaces 16 comprised between the projections 9, 9*a* and the stops 8, 8*a* whilst being simultaneously in contact with both the stop face 12 of the orientation stop and the start of the lobe 9, 9*a*.

As may be seen in FIG. 2, the lobes 9, 9*a* are situated, with reference to the screwing down direction F of the stopper onto the neck 4, ahead of the stops 8, 8*a*.

The bottle 1 may have a polyhedral shape, in particular with a square or rectangular cross section, as schematically outlined in FIG. 2. The stopper 2 also has a polyhedral shape with a substantially square cross section as shown in FIG. 2. The catches 10, 10*a* are symmetrical in relation to the axis of this stopper and are each situated near an inner corner of the transverse cross section of the stopper. The catches 10, 10*a* are therefore situated substantially at the ends of one diagonal of the transverse cross section of the stopper. A radially inner surface 17 of each catch 10, 10*a* is situated slightly outside the cylindrical surface externally enveloping the tops of the thread 3 so that as stopper 2 is being positioned on the bottle neck, the catches 10, 10*a* do not interfere with the thread 3. Since the catches 10, 10*a* are provided near a corner of the transverse cross section of the stopper, in a zone relatively remote from the contour of the neck 4, there is sufficient space for the formation of these somewhat deformable catches 10, 10*a* without it being necessary to make provision for a protuberance on the external contour of stopper 2. The stopper 2 may therefore have substantially flat external sides without any protuberance in its lower portion. The internal thread of the stopper 2 is provided in a duct (not visible in the drawings) whose internal radius is smaller than the radial spacing of the sides 17 from the stopper axis.

The functioning of the stopper device is as follows:

Positioning of the stopper 2 on the neck 4 of the bottle is effected by a screwing action. On completion of the screwing action, the inwardly projecting male catches 10, 10*a* of the stopper first come into contact with the rounded lobes 9, 9*a*. The user then feels a first resistance which he must overcome in order to cause the catches 10, 10*a* to cross the lobes 9, 9*a*. This crossing is possible because the lobes 10, 10*a* are slightly deformable; moreover, the walls of the stopper 2 which carry the lobes 10, 10*a* can also be slightly deformed.

When the lobes 9, 9*a* have been crossed by the catches 10, 10*a* the stopper 2 occupies the position represented in FIG. 2, and the faces 13 of the stops 8. 8*a*. The stopper 2 is then completely arrested in a position which practically cannot be exceeded without destruction of the catches.

Accidental unscrewing of the stopper is prevented by the cooperation of catches 10, 10*a* with the lobes 9, 9*a* for the reverse direction of rotation to that represented by arrow F in FIG. 2.

To unscrew the stopper, it is necessary to exert a sufficient force on the stopper to cause the catches 10, 10*a* to pass the lobes 9, 9*a* in the reverse direction to that of arrow F.

This stoppering device may be provided on stoppers which screw up through only a quarter turn or those requiring several turns, since the catch or catches of the stopper only come to be catch-engaged between the lobe and the orientation stop of the bottle neck at the end of the complete "screwing down" axial movement of the stopper.

It should be noted that the lobe as well as the orientation stop are provided on the accurately shaped injection moulded neck of the bottle. The remaining part of the bottle, generally obtained by blow moulding, frequently has dimensional characteristics which are less accurate than those of the bottle.

The stopper is generally made of a moulded plastic material and the catches 10, 10*a* form an integal part of this stopper.

We claim:

1. In a container comprising a bottle having stoppering means with an indexed closure position relative to the bottle;

wherein said stoppering means comprise an internally threaded stopper;

wherein said bottle includes a body; a bottle neck; external thread means on the bottle neck; a flange on said bottle neck and situated axially between the lower end of the external thread means and said body of the bottle, the bottle neck comprising at least first and second radially outwardly projecting catches on said flange, said first catch constituting an orientation stop and said second catch constituting a lobe to prevent unscrewing;

wherein the stopper comprises at least a third catch which is slightly deformable and which, upon completion of screwing down becomes accommodated between said first and second catches of the bottle neck;

the improvement wherein:

(a) said orientation stop and said lobe have different shapes;

(b) said orientation stop extends along a direction parallel to the axis of the bottle neck over an axial extent exceeding the axial extent of said flange; and (c) said thread of the bottle neck is positioned to a first side of said flange and said orientation stop projects on the second side of said flange.

2. A container according to claim 1 wherein said orientation stop continues as far as said body of the bottle.

3. A container according to claim 1 wherein said orientation stop has a flat radial face constituting a flat radial stop face capable of cooperating with a corresponding face of said third catch.

4. A container according to claim 3 wherein said orientation stop has an outwardly convex rounded face beyond said flat radial stop face.

5. A container according to claim 1, wherein said flange has first and second faces with said first face nearer to said thread means, and wherein said orientation stop starts at the level of said first face of the flange.

6. A container according to claim 1, wherein there are two pairs of diametrically opposite first and second catches on the neck of the bottle, each of said pairs being constituted by one said orientation stop and one said lobe, and wherein the stopper comprises two diametrically opposite said third catches each associated with a respective said pair of first and second catches of the bottle neck.

7. A container according to claim 1, wherein said lobes are entirely situated on said flange and have a rounded shape which is symmetrical in relation to a plane passing through the longitudinal axis of the bottle neck and through the centre of the lobe considered along the peripheral direction of the bottle neck.

8. A container according to claim 1, wherein the stopper has a polyhedral shape, and said third catch is situated near an inner corner of the transverse cross section of the stopper.

9. A container according to claim 8, wherein the stopper comprises two diametrically opposite said third catches which are situated substantially at the ends of one diagonal of the transverse cross section of the stopper.

10. In a bottle made of glass or other rigid material intended to be provided with internally threaded stoppering means comprising an inwardly projecting catch below the thread of the stoppering means, said bottle comprising: a neck; a thread on said neck; a flange on said neck; and at least second and third catches on said neck, of which said second catch constitutes an orientation stop and said third catch constitutes a lobe to prevent unscrewing; the improvement wherein:

(a) said orientation stop and said lobe to prevent unscrewing have different shapes;

(b) said orientation stop extends along a direction parallel to the axis of the bottle neck over a height which is greater than that of the flange; and (c) in relation to said flange, said orientation stop projects on the side opposite to that at which the thread is positioned.

* * * * *